343-756 SR

7/27/82 OR 4,342,034

United States Patent [19]

Monser

[11] 4,342,034

[45] Jul. 27, 1982

[54] RADIO FREQUENCY ANTENNA WITH POLARIZATION CHANGER AND FILTER

[75] Inventor: George J. Monser, Goleta, Calif.

[73] Assignee: Raytheon Company, Lexington, Mass.

[21] Appl. No.: 209,935

[22] Filed: Nov. 24, 1980

[51] Int. Cl.[3] ..... H01Q 15/12

[52] U.S. Cl. ..... 343/756; 343/909

[58] Field of Search ..... 343/753, 754, 755, 756, 343/909, 911 R

[56] References Cited

U.S. PATENT DOCUMENTS 3,031,664 4/1962 Wielobob ..... 343/756

4,127,857 11/1978 Capps et al. ..... 343/756

*Primary Examiner*—Eli Lieberman

*Attorney, Agent, or Firm*—Richard M. Sharkansky; Joseph D. Pannone

[57] ABSTRACT

A radio frequency antenna is provided wherein an array of antenna elements is adapted to establish linearly polarized radio frequency energy. A polarizer means is disposed between the array of antenna elements and free space for converting the linearly polarized radio frequency energy associated with the antenna elements into circularly polarized radio frequency energy in free space, such polarizer means being disposed about a frontal portion and side portions of the array antenna elements. A polarization filter means for rejecting radio frequency energy having a selected linear polarization is disposed between the side portions of the array of antenna elements and the polarizer means. In a preferred embodiment of the invention, the polarization filter is disposed to reject radio frequency energy having a linear polarization, such linear polarization being disposed at an acute angle with respect to the linear polarization provided by the antenna elements. More specifically, the polarization filter is oriented 45 degrees with respect to the polarization of the radio frequency energy associated with the antenna elements. With such arrangement, the degree of circular polarization of the radio frequency energy in free space provided by the array antenna is improved for beams directed at relatively large scan angles.

8 Claims, 8 Drawing Figures

RADIO FREQUENCY ANTENNA WITH POLARIZATION CHANGER AND FILTER

BACKGROUND OF THE INVENTION

This invention relates generally to radio frequency antennas and more particularly to array antennas adapted to operate with circularly polarized radio frequency energy.

As is known in the art, it is frequently desired to provide an array antenna adapted to operate with circularly polarized radio frequency energy over relatively large scan angles. In one such array antenna a plurality of antenna elements are disposed along a linear path, each one of the antenna elements includes a double-ridged flared radiating structure fed to establish linearly polarized radio frequency energy; i.e. radio frequency energy having its electric field vector disposed normal to the wide surfaces of the antenna element. An externally mounted polarizing structure is then disposed between free space and the array antenna elements to convert the linearly polarized radio frequency energy provided by the antenna elements to circularly polarized radio frequency energy on transmit and to convert, on received, circularly polarized energy in free space to linearly polarized radio frequency energy for collection by the array antenna elements. In the array antenna described above, the polarizing structure is wrapped around the front and side portions of the arrayed antenna elements. While such antenna provides satisfactory results when operating over relatively small scan angles, as the beam provided by the antenna is scan to relatively wide scan angles, ±60 degrees from boresight, for example, the gain of the antenna at such large scan angles decreases significantly thereby reducing the effectiveness of the antenna at such large scan angles.

SUMMARY OF THE INVENTION

In accordance with the present invention, a radio frequency antenna is provided wherein an array of antenna elements is adapted to establish linearly polarized radio frequency energy. A polarizer means is disposed between the array of antenna elements and free space for converting the linearly polarized radio frequency energy associated with the antenna elements into circularly polarized radio frequency energy in free space, such polarizer means being disposed about a frontal portion and side portions of the array antenna elements. A polarization filter means for rejecting radio frequency energy having a selected linear polarization is disposed between the side portions of the array of antenna elements and the polarizer means.

In a preferred embodiment of the invention, the polarization filter is disposed to reject radio frequency energy having a linear polarization, such linear polarization being disposed at an acute angle with respect to the linear polarization provided by the antenna elements. More specifically, the polarization filter is oriented 45 degrees with respect to the polarization of the radio frequency energy associated with the antenna elements.

With such arrangement, the degree of circular polarization of the radio frequency energy in free space provided by the array antenna is improved for beams directed at relatively large scan angles.

BRIEF DESCRIPTION OF THE DRAWINGS

The foregoing and other features of this invention, as well as the invention itself, may be more fully understood from the following detached description read together with the accompanying drawings, in which.

DESCRIPTION OF THE PREFERRED EMBODIMENT

Figure 1:
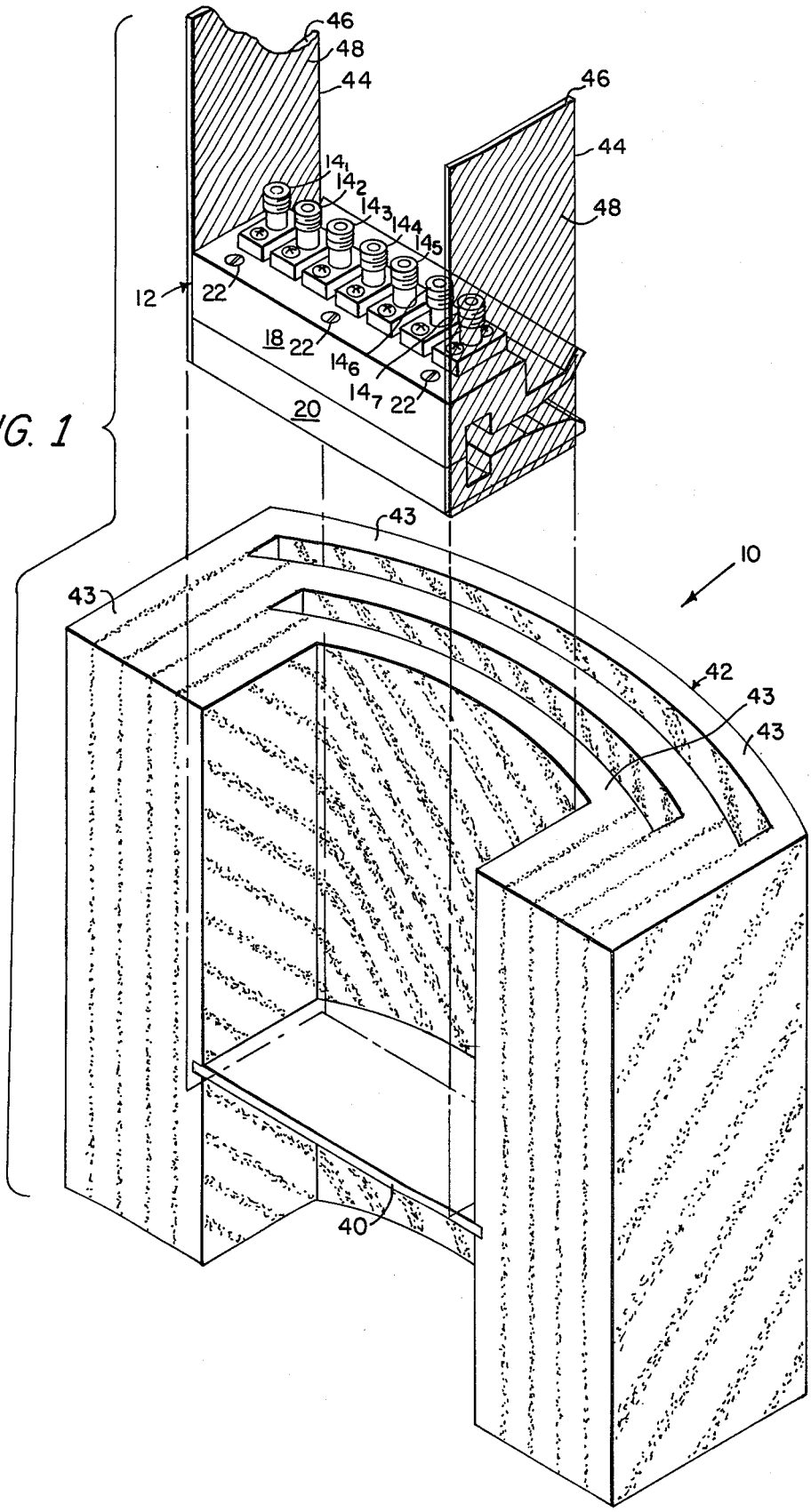
FIG. 1 is an exploded, isometric drawing of an array antenna according to the invention.
Figure 2:
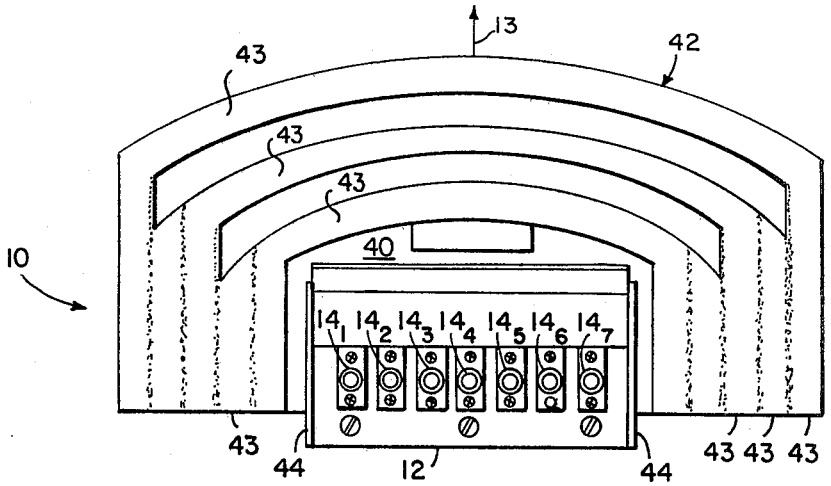
FIG. 2 is a top plan view of the antenna of FIG. 1.
Figure 3:
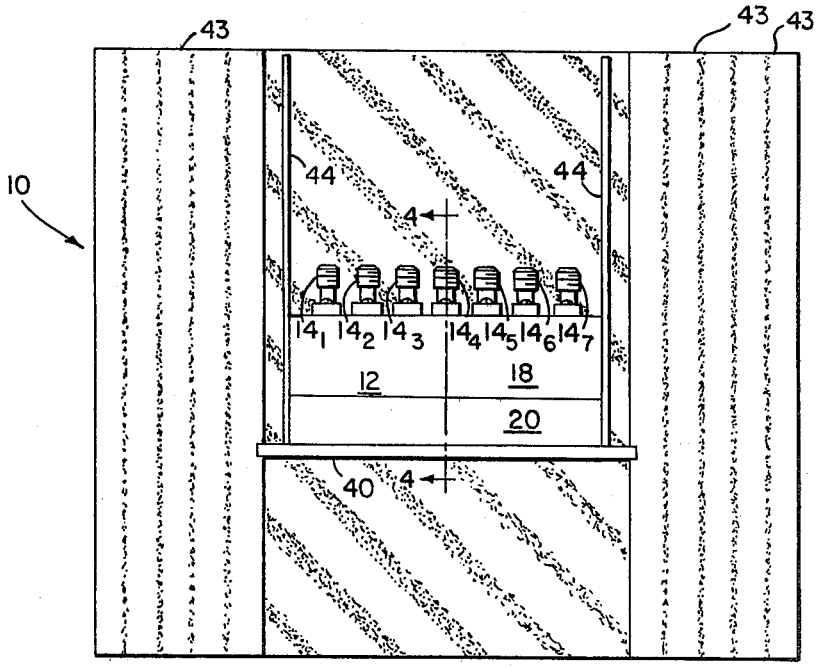
FIG. 3 is a rear elevation view of the antenna of FIG. 1.
Figure 4:
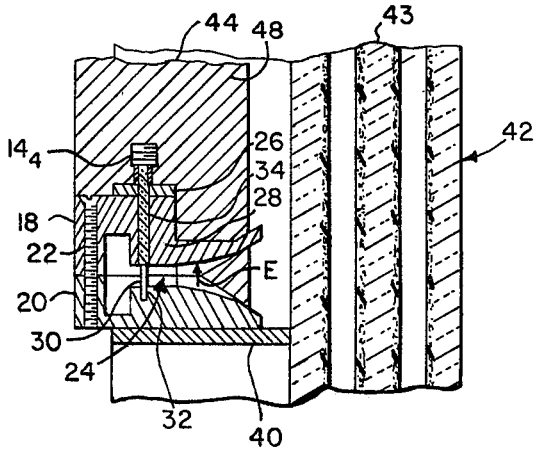
FIG. 4 is a cross-section elevation view of a portion of the antenna of FIG. 1, such cross-section being taken along line 4—4 of FIG. 3.

Referring now to FIGS. 1–3 an array antenna system 10 is shown, such system 10 being adapted to produce a beam of circularly polarized radio frequency energy in free space, such beam having a direction from boresight axis 13 in accordance with the relative phase distribution of radio frequency energy fed to the antenna elements, here 7 elements, of the array 12 via coaxial connectors $\mathbf{14}_1$–$\mathbf{14}_7$ from a conventional transmitter, not shown. The array 12 includes a conductive housing made up of an upper section 18 and a lower section 20 fastened together through bolts 22, as shown. As mentioned above, here the array 12 includes seven antenna elements, an exemplary one thereof being shown in FIG. 4. Antenna element 24, as shown in FIG. 4, is here a double ridged, flared radiating structure wherein the outer conductor 26 of the coaxial connector $\mathbf{14}_4$ is electrically connected to a first conductor member 28 and the inner conductor 30 of such coaxial connector $\mathbf{14}_4$ is electrically connected to a second, lower conductive member 32, such inner conductor 30 passing in nonconductive relationship through the first conductive member 28 by means of a dielectric sleeve 34 which passes around such inner conductor 30 in the region where it passes through the first conductive member 28. Thus, radio frequency energy fed to antenna element 24 is linearly polarized having a vertical electric-field vector represented by the vector labeled E.

The array 12 rests on a nonconductive platform 40 set into a polarizer 42, as shown. Thus, the frontal portion and open ended side portions of the array 12 are wrapped by the polarizer 42. Polarizer 42 converts the linearly polarized radio frequency energy transmitted by the array 12 into circularly polarized radio frequency energy in free space. Reciprocally, in the receive mode, circularly polarized radio frequency energy in free space is converted into linearly polarized radio frequency energy, such converted energy being received by the array 12, the phase distribution of such received energy across connectors $14_1$–$14_8$ being in accordance with the direction of the received radio frequency energy. Here, polarizer 42 includes a plurality of sheets 43, such sheets 43 including meander line conductors embedded in a dielectric. The meander lines are disposed at 45 degree angles to the electric-field vector E. Thus, polarizer 42 is a conventional meander line polarizer such as that described by L. Loung, L. A. Robinson, C. A. Hacking "Meander-Line Polarizer "IEEE Transaction Antennas and Propagation AP May 1973, pp. 376-14 378.

Figure 5:
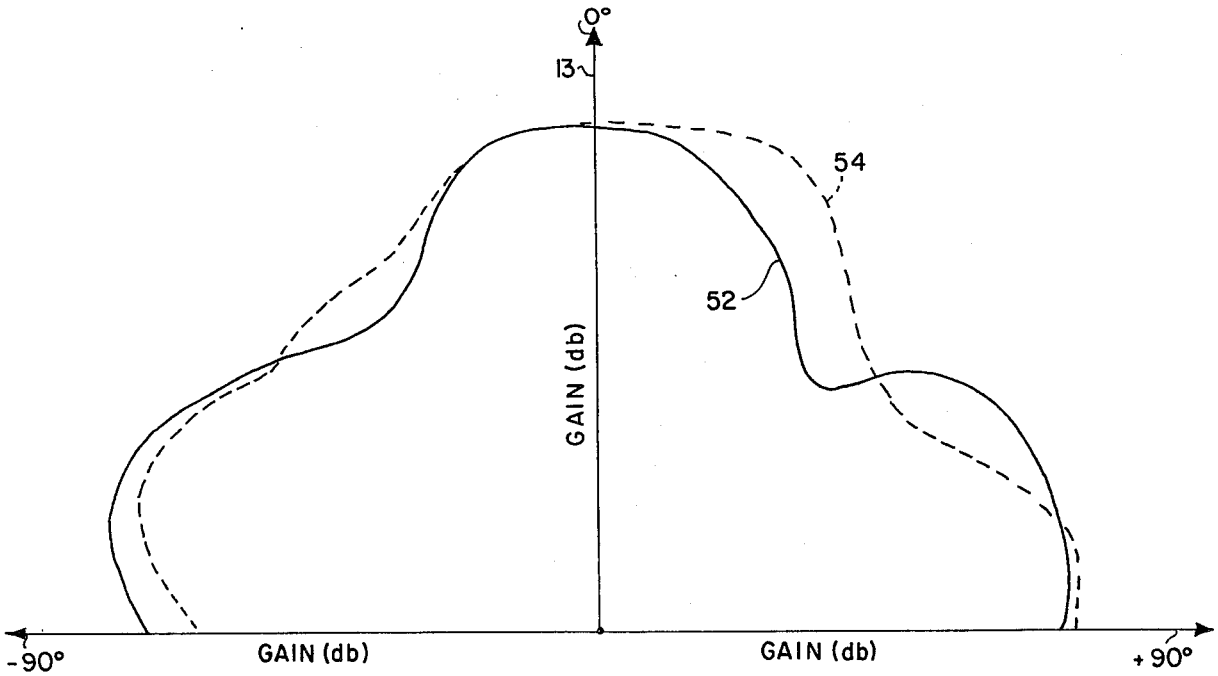
FIG. 5 are gain curves of an antenna system without polarization filters.
Figure 6:
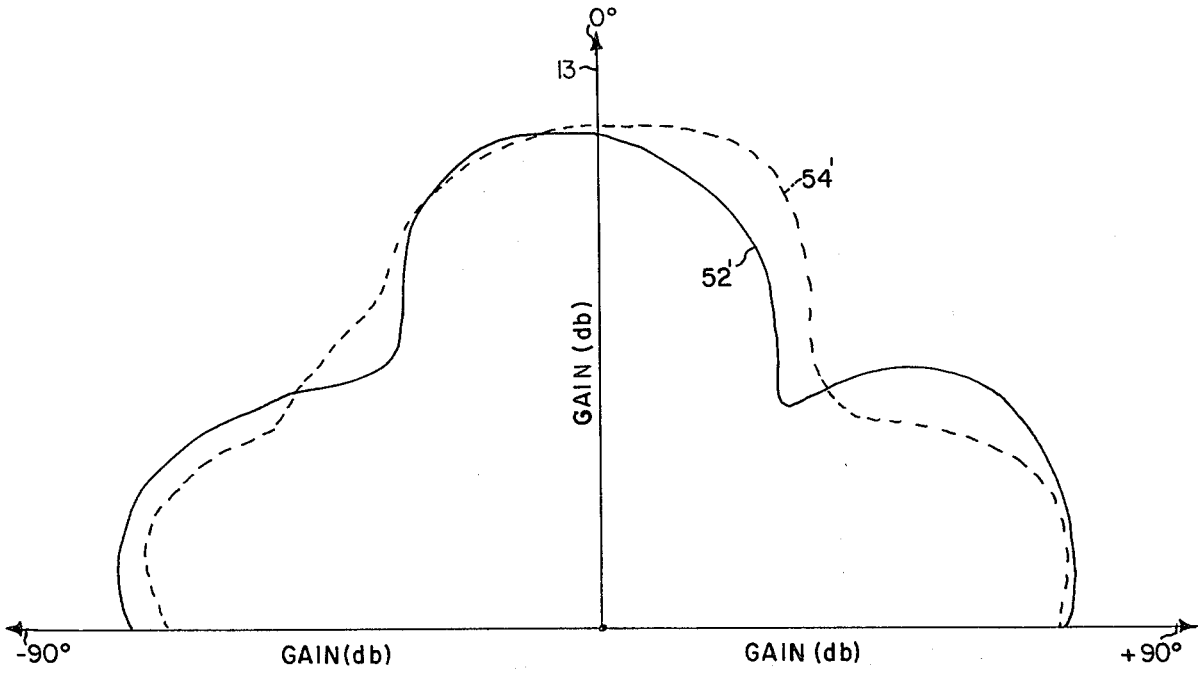
FIG. 6 are gain curves of an antenna system with polarization filters oriented to reject cross-polarized energy components.

Completing the antenna system 10 is a pair of polarization filters 44 affixed to the open ended portions of the array 12 by any suitable nonconductive epoxy, not shown. The polarization filters 44 are of any conventional design and include a dielectric substrate 46 having linear conductive lines 48 formed thereon. The spacing between conductive lines 48 is here less than one tenth of the wavelength of the smallest operating wavelength of the antenna system 10. As is known, the polarization filter 44 allows polarized radio frequency energy having linear polarization with an electric-field vector normal to the conductive lines 48 to pass through such filter 44 while rejecting or preventing from passing through such filter 44 radio frequency energy having a linear polarization or electric-field vector disposed parallel to such conductive lines 48. It is noted here that the conductive lines 48 are disposed at an acute angle, here 45 degrees, with respect to the linear polarization, i.e. the electric-field vector E, associated with each of the antenna elements 24 of the array 12. The disposition of the conductive wire 48 at such acute angle with respect to the orientation of the linear polarization associated with the array 12 has provided an improvement in the antenna gain pattern associated with the antenna system 10 particularly at relatively large scan angles from the boresight axis 13. Referring to FIG. 5 the antenna pattern for an array antenna without any polarization filters 44 is shown when such antenna received vertically polarized energy and horizontally polarized energy as shown by curves 52, 54, respectively. It is noted that there is a significant reduction in antenna gain near ±40 degrees of scan angle from boresight axis 13. FIG. 6 shows gain of the antenna system with polarization filters 44; here however, the conductive lines 48 are disposed orthogonal to the linear polarization or electric-field vector E of the antenna elements. That is, if the electric-field vector E or polarization of the antenna elements is considered to be vertical, here the conductive lines 48 are disposed along horizontal lines. The motivation in orienting the filters 44 in this way might be on the theory that the reduction in antenna gain shown in FIG. 5 might be the result of cross-polarization components produced by the interaction of the array 12 and the polarizer 42, i.e. the generation of horizontally oriented polarization components, and thus by orientating the conductive lines 48 in the horizontal direction these unwanted cross-polarization components would be filtered. It is noted, however, from FIG. 6 that there is still a reduction in antenna gain at to ±40 degrees scan angles for both the vertically polarized energy and the horizontally polarized energy as shown by curves 54', 54', respectively.

Figure 7:
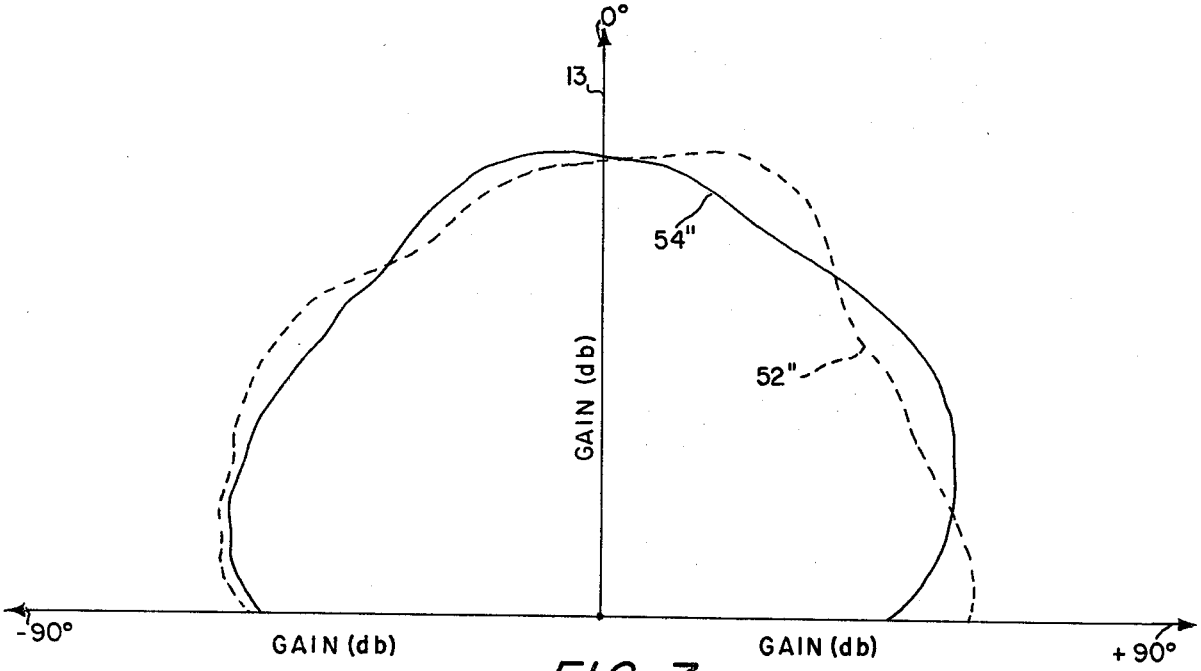
FIG. 7 are gain curves of the array antenna system of FIG. 1 wherein polarization filters thereof are disposed at an acute angle with respect to the linear polarized energy associated with the array of antenna elements used in such system.
Figure 8:
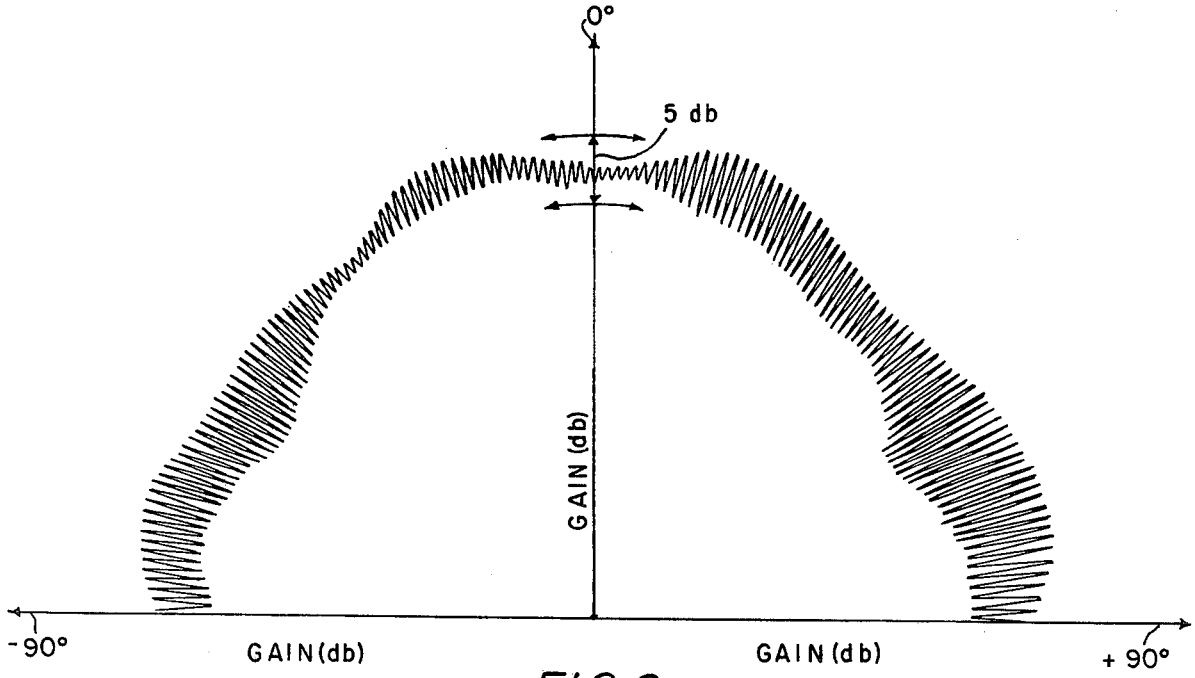
FIG. 8 is a gain curve of the array antenna system wherein polarization filters thereof are disposed at an acute angle with respect to the linear polarized energy associated with the array of antenna elements used in such system, when such antenna system receives rotating linearly polarized radio frequency energy.

Referring now to FIG. 7 the antenna gain for the antenna system 10 with the conductive wires 48 of the polarization filters 44 disposed along lines making an acute angle, here 45 degrees, with the electric-field vector E, is shown. It is noted that with such orientation the gain of the antenna is relatively smooth over a significantly wide range of scan angles for both vertically polarized energy and horizontally polarized energy as shown by curves 52'', 54'', respectively. Thus, the use of polarization filters 44 disposed between the open ends of the array 12 and the polarizer 42 and oriented at an acute angle with respect to the linearly polarized radio frequency energy associated with the array 12 significantly improves the antenna gain pattern of the system 10. The response of the antenna system 10 to rotating linearly polarized energy is shown in FIG. 8 with such antenna system 10 having the polarization filters 44 disposed at the 45 degree acute angle with respect to the electric field vector E. Thus, here the antenna system 10 receives linearly polarized energy which is rotated in space at a predetermined rate while the antenna system 10 is scanned from +90 degrees to −90 degrees at a rate less than the predetermined rate at which the linearly polarized energy is rotated in space. Since the envelopes of the curve in FIG. 8 (i.e. the axial ratio) are not separated by more than 6 db over ±50 degrees of scan angle circular polarization has been maintained over substantially all of the 180 degrees of scan angle.

Having described a preferred embodiment of this invention, it is now evident that other embodiments incorporating these concepts may be used. It is felt, therefore, that this invention should not be restricted to the disclosed embodiment but rather should be limited only by the spirit and scope of the appended claims.

What is claimed is:

1. A radio frequency antenna comprising:

(a) an array of antenna elements adapted to produce radio frequency energy having linear polarization;

(b) a polarizer means disposed between a frontal portion and side portions of the array for converting the linearly polarized radio frequency energy into circularly polarized radio frequency energy;

(c) a pair of polarization filters disposed between the side portions of the array and the polarizers, such filters being disposed at an acute angle with respect to the linear polarization of the energy produced by the array.

2. The antenna recited in claim 1 wherein the end portions of the array are open.

3. The system recited in claim 2 wherein the polarization filters include conductive lines disposed at an acute angle with respect to the linear polarization produced by the array.

4. The antenna system recited in claim 3 wherein the acute angle is 45 degrees.

5. A radio frequency antenna comprising:

(a) an array of antenna elements adapted to produce radio frequency energy having linear polarization;

(b) a polarizer means disposed between a frontal portion and side portions of the array for converting the linearly polarized radio frequency energy into circularly polarized radio frequency energy;

(c) a pair of polarization filters disposed between the side portions of the array and the polarizer means, such polarization filters including conductive lines, such lines being disposed at acute angles with respect to the linearly polarized energy produced by the array.

6. The antenna recited in claim 5 wherein the acute angle is 45degrees.

7. A radio frequency antenna comprising:

(a) an array of antenna elements adapted to produce radio frequency energy having linear polarization;

(b) a polarizer means disposed between a frontal portion and side portions of the array for converting the linearly polarized radio frequency energy into circularly polarized radio frequency energy;

(c) a pair of polarization filter means, disposed between the side portions of the array and the polarizer, for selectively preventing radio frequency energy components from passing therethrough having linearly polarization disposed at an acute angle with respect to the linear polarization of the energy produced by the array and allowing radio frequency energy components to pass therethrough having a linear polarization disposed normal to the polarization of the rejected radio frequency energy.

8. The antenna recited in claim 7 wherein the acute angle is 45 degrees.

* * * * *